United States Patent [19]

Meister

[11] Patent Number: 4,986,604

[45] Date of Patent: Jan. 22, 1991

[54] ROADWAY GROOVING APPARATUS

[75] Inventor: Donald F. Meister, Overland Park, Kans.

[73] Assignee: Target Products Inc., Kansas City, Mo.

[21] Appl. No.: 307,816

[22] Filed: Feb. 7, 1989

[51] Int. Cl.[5] ..... E01C 23/09

[52] U.S. Cl. ..... 299/39; 51/176; 404/90

[58] Field of Search ..... 299/36, 38, 39; 404/90, 404/93; 51/176

[56] References Cited

U.S. PATENT DOCUMENTS

| | | | |
|---|---|---|---|
| 2,311,891 | 2/1943 | Tyson | 299/39 |
| 3,572,842 | 3/1971 | Mori | 51/176 X |
| 3,874,806 | 4/1975 | Grist et al. | 404/93 |

FOREIGN PATENT DOCUMENTS

| | | | |
|---|---|---|---|
| 283286 | 9/1988 | European Pat. Off. | 404/90 |

*Primary Examiner*—Bruce M. Kisliuk
*Assistant Examiner*—David J. Bagnell
*Attorney, Agent, or Firm*—Sixbey, Friedman, Leedom & Ferguson

[57] ABSTRACT

A machine for cutting transverse grooves in a concrete road surface includes a rotary cutter head supported on a carriage that can be shifted longitudinally along the machine frame structure. By using a combination of motions of the frame structure and cutter head carriage it is possible to form grooves spanning substantially the entire distance from one curb to the other curb during a single pass of the machine.

17 Claims, 3 Drawing Sheets

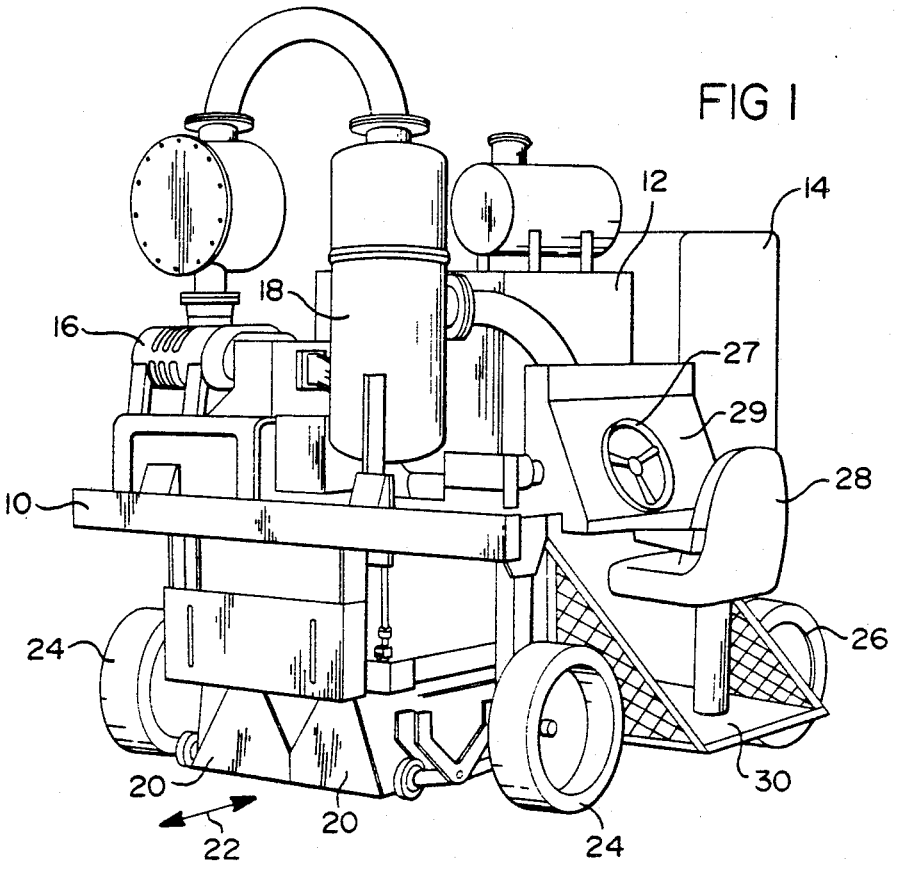
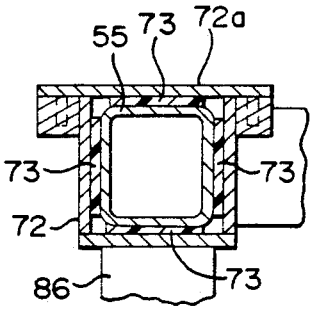
FIG 5
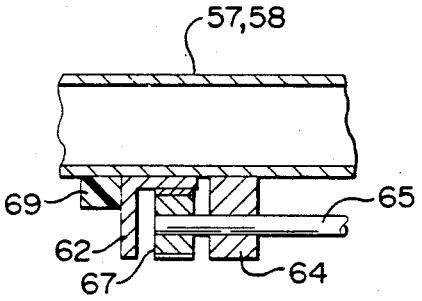
FIG 7

ROADWAY GROOVING APPARATUS

BACKGROUND OF THE INVENTION

1. Field of the Invention

The present invention is generally concerned with a machine for forming spaced parallel grooves in concrete road surfaces Such grooves serve to improve tractive friction between vehicle tires and the road surface and act as miniature channels for draining water from the road surface, thereby minimizing water films that can promote skidding and loss of vehicle control due to hydroplaning.

2. Description of Prior Developments

Machines for cutting transverse grooves in road surfaces, i.e. grooves that run transverse to the longitudinal axis or center line of the roadway are required to move transversely across the road surface. The rear road wheels of the machine are located behind the rotary cutting head and the front road wheels are located in front of the rotary cutting head. This positioning of the road wheels has heretofore prevented the cutting head from achieving a full traverse cut from curb to curb in a single pass of the machine. To achieve a full traverse of the cutting head, it is necessary to move the machine as far as possible in one pass, and to then turn the machine around (end for end) to make a second pass to cover the space not covered in the first pass. This procedure consumes time and thus increases the total cost of the road-grooving operation.

An example of such a machine is discussed in U.S. Pat. No. 4,333,685 to J. Arnswald. Additional groove-cutting machines are shown in U.S. Pat. No. 3,703,316 to C. W. Hatcher, U.S. Pat. No. 3,868,146 to S. Ellis, and U.S. Pat. No. 3,608,969 to J. Fowkes.

SUMMARY OF THE INVENTION

The present invention is directed to a road surface-grooving machine that is capable of forming full length transverse grooves in the road surface, using only a single pass or traverse of the machine across the road surface.

One machine embodying the invention comprises a carriage slidably arranged on a sub-frame that is floatably positioned below the main frame of the machine. The groove-cutting head structure is suspended from the carriage so that grooves can be formed in a pavement surface by shifting the carriage longitudinally along the sub-frame with the main frame in a stationary position. Grooves can also be cut into the road surface by bodily moving the main frame from one curb to the other curb. By using a combination of motions of the carriage and main frame it is possible to form "full length" grooves in the road surface, using a single pass of the machine. The term "full length" is here used to mean substantially the entire transverse dimension of the road surface, from one curb to another.

The present invention is especially useful on highway bridges, where turnaround space for the grooving machine is limited. A machine designed in accordance with the present invention is able to cut traverse grooves in an entire bridge road surface without turning the machine around. The machine can be manipulated (driven) back and forth across the road surface with a minimum amount of lost motion maneuvering.

BRIEF DESCRIPTION OF THE DRAWINGS

FIG. 1 is a perspective view of a groove-cutting machine embodying the present invention.

FIG. 5 is an enlarged fragmentary sectional view on line 5—5 in FIG. 2.

FIG. 7 is a fragmentary view of a structural detail used in the FIG. 2 mechanism.

DESCRIPTION OF A PREFERRED EMBODIMENT OF THE INVENTION

Figure 2:
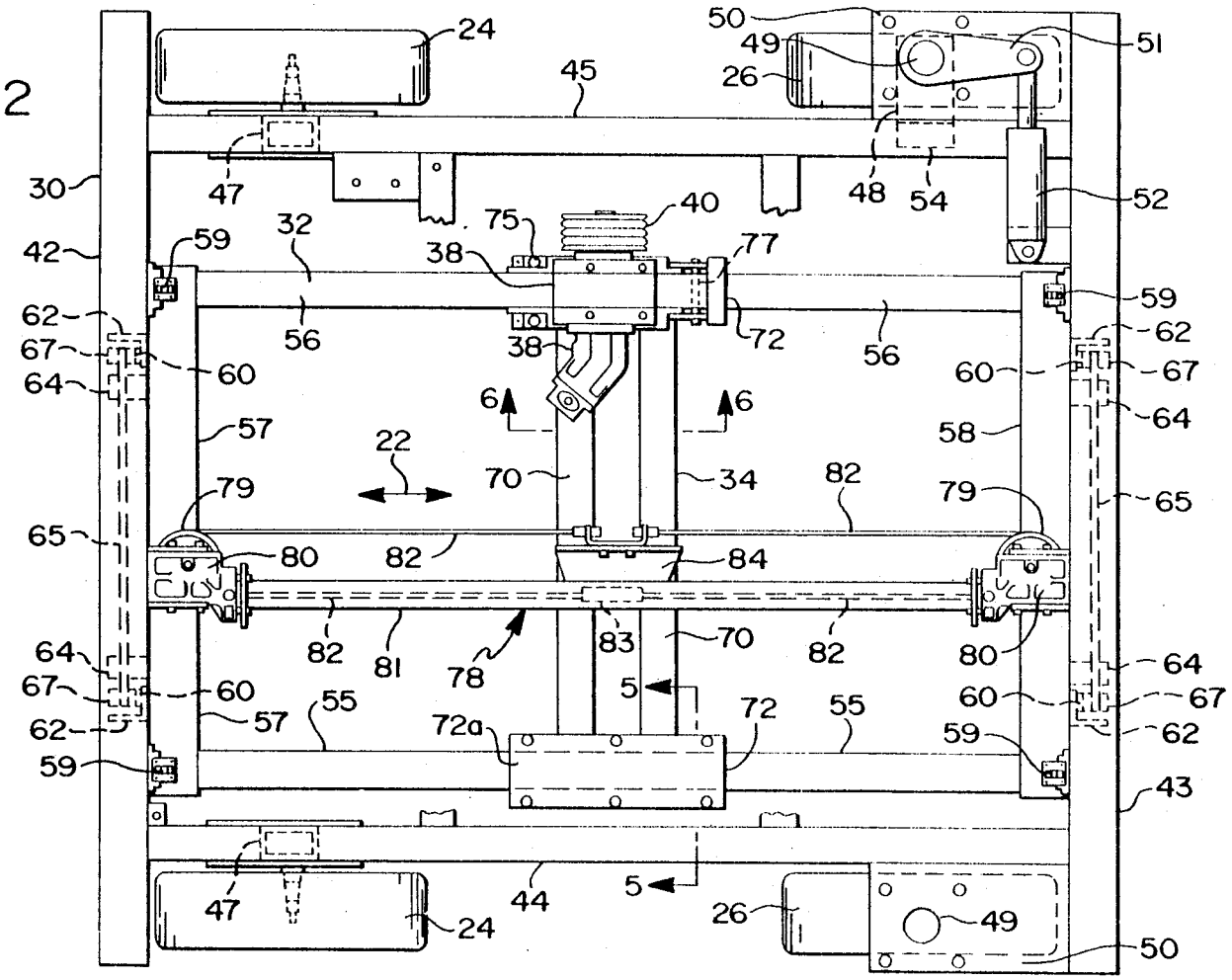
FIG. 2 is a top plan view of the FIG. 1 machine, with certain parts removed to show internal mechanisms and features

As seen in the drawings, a machine is specially designed for cutting grooves that run transversely across a road surface, i.e. crosswise of the road surface centerline. As shown in FIG. 1, the machine includes a frame structure 10 for supporting components normally used on machines of a similar type, e.g. an engine 12, diesel fuel tank 14, vacuum pump 16 for drawing water-grit slurry from the road surface, and a cyclone-type separator 18 for separating the grit out of the slurry discharged from pump 16. The groove-cutting blades (discs) are not visible in FIG. 1, but are located within shroud structure 20.

The machine is supported for movement in the direction of arrow 22 by means of non-steerable road wheels 24 and steerable road wheels 26. The operator of the machine can be seated on a seat structure 28 in front of a control panel 29 located on a platform 30 that is suitably attached to frame structure 10. The operator is located at the side of the machine where he can look down onto the pavement surface to observe grooves already cut, thereby enabling him to steer the machine so as to have the newly-cut grooves parallel and properly spaced relative to the previously cut grooves.

The machine is reversible, i.e. it can move to the left along pathline 22 or it can move to the right along pathline 22. By turning the steering wheel 27 the operator can adjust road wheels 26 so as to change the direction and location of pathline 22, e.g. at the end of each pass of the machine transversely across the road surface.

Figure 3:
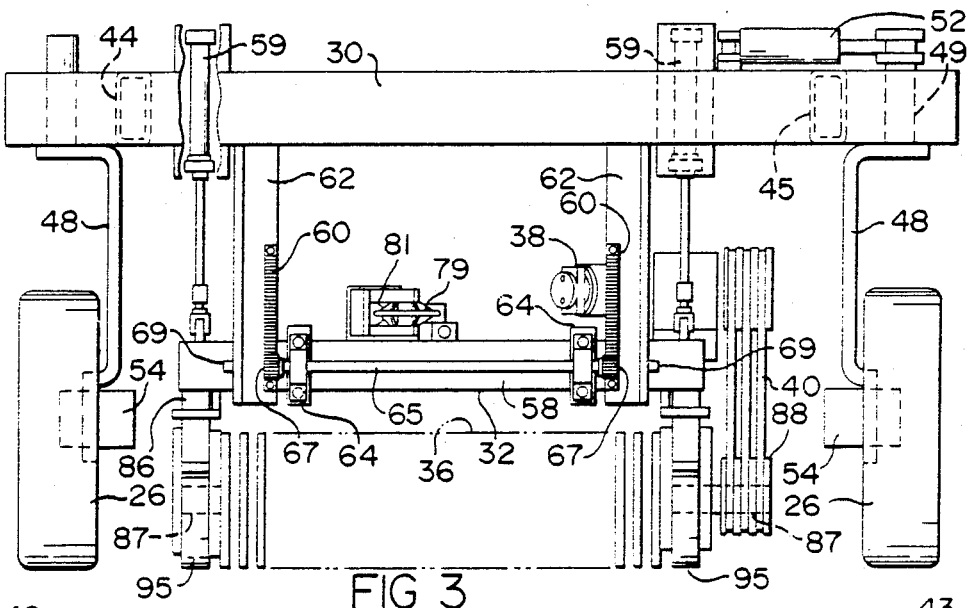
FIG. 3 is an end elevational view of the FIG. 2 structure.
Figure 4:
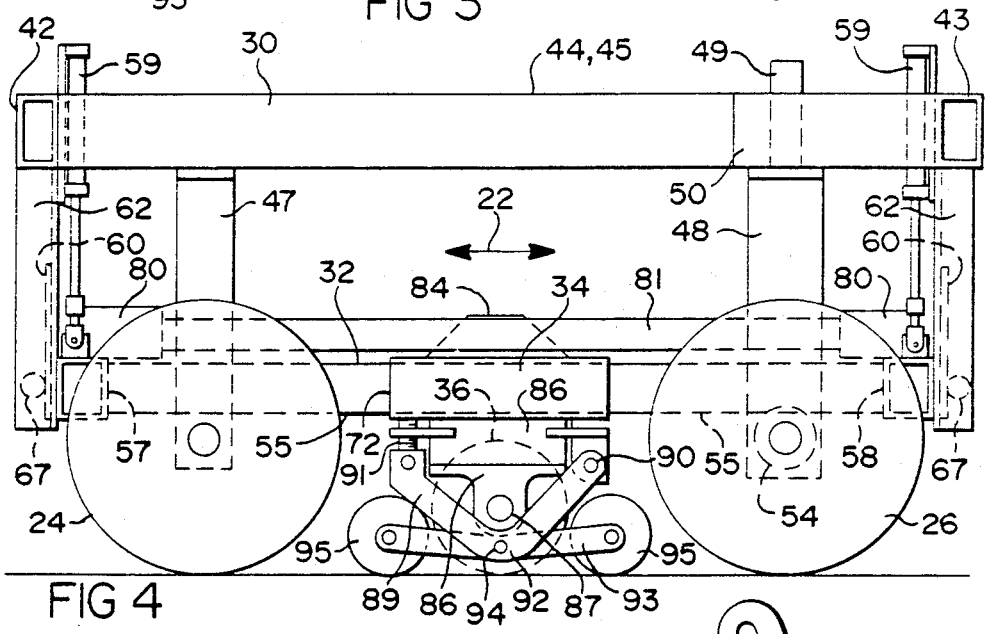
FIG. 4 is a side elevational view of the FIG. 2 structure.

FIGS. 2 through 4 illustrate structural features believed to be new in the art. The aforementioned frame structure 10 comprises a main frame 30 and a floatable sub-frame 32. A carriage 34 is slidably mounted on the sub-frame for horizontal motion in the direction of arrow 22, i.e. parallel to the movement path established by road wheels 24 and 26. A conventional rotary cutting head 36 is located directly below the carriage for movement therewith. Hydraulic motor 38 drives the rotary cutting head via drive belts 40. The aforementioned shroud 20 is not shown in FIGS. 2 through 4 in order to show other details of more immediate interest.

By way of briefly describing the operational mode of the FIG. 2 mechanism, frame structure 10 is moved bodily along pathline 22 by delivering power (torque) to road wheels 26. The rotary cutting head 36 forms closely spaced parallel grooves in the pavement surface from a point near one curb to a point spaced some distance from the other curb. In a typical arrangement the spaced distance might be on the order of four feet. Grooves are formed in this remaining four foot distance by shifting carriage 34 along sub-frame 32. As the carriage moves along the sub-frame with main frame 30 motionless, cutting head 36 forms grooves over a distance corresponding to the carriage 34 movement The components of the machine may be constructed and configured in various ways. As shown in FIG. 2, main frame 30 includes two end beams 42 and 43, and two side beams 44 and 45. Road wheels 24 are attached to the main frame via upstanding posts 47. Road wheels 26 are attached to the main frame via brackets 48. An upstanding pin 49 is affixed to the upper end of each bracket 48 for swivel mounting in a socket suitably formed in frame attachment 50. The extreme upper end of each pin 49 is attached to a steering arm 51 that is operably connected to a hydraulic cylinder 52. Although FIG. 2 shows one cylinder 52, in practice there would be two such cylinders, one for each road wheel 26.

The lower end of each bracket 48 is affixed to a hydraulic motor 54 whose output shaft forms an axle for the associated roadwheel 26. The two hydraulic motors 54 provide motive power for moving the machine bodily along the road surface. The two hydraulic cylinders 52 provide steering inputs to road wheels 26, to thus control the direction taken by the vehicle.

Sub-frame 32 includes two longitudinally extending side rails 55 and 56, and two end rails 57 and 58. A vertically-oriented double-acting fluid cylinder 59 is located at each corner of the sub-frame. The cylinder portion of each fluid cylinder 59 is attached to main frame 30, whereas the piston rod portion of each fluid cylinder is attached to an end portion of one of the sub-frame end rails 57 or 58. The four fluid cylinders 59 are intended to be connected to fluid pressure sources having the same pressure valve, such that sub-frame 32 is caused to move up or down in rectilinear fashion, i.e. the four corners of the sub-frame have the same equalized travel during up or down motion of the sub-frame.

A rack-pinion gear system may be utilized to ensure equalized travel of the sub-frame corners In the illustrated system, toothed racks 60 are affixed to angle members 62 that extend downwardly from main frame end beams 42 and 43. Each sub-frame end rail 57 or 58 carries two pillow block bearings 64 that serve to rotatably support a horizontal shaft 65 Pinion gears 67 are affixed to opposite ends of each shaft 65 in meshed engagement with the associated racks 60.

Each shaft 65 interconnects the two associated pinions 67 so that the connected pinions are forced to rotate at the same rate. The effect is to promote an equalized travel rate for the opposite ends or corners of each sub-frame end rail. Sidewise shift of the sub-frame can be prevented by anti-friction pads 69 affixed to the sub-frame end rails alongside each angle member 62 (as shown in FIG. 7).

Figure 6:
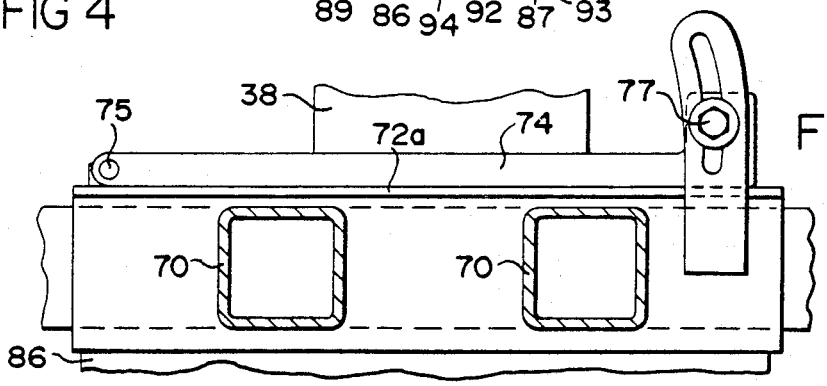
FIG. 6 is an enlarged fragmentary sectional view on line 6—6 in FIG. 2.

Carriage 34 includes a transversely-extending bridge section 70 having two similarly constructed anti-friction sleeves 72 connected to opposite ends of the bridge section. The bridge section can be formed by two hollow steel tubes as shown in FIG. 6.

FIG. 5 illustrates some features of a representative anti-friction sleeve 72. The sleeve slidably encircles the associated sub-frame side rail so that the carriage can move along the two side rails 55 and 56 in the direction of arrow 22 (FIG. 2). Each sleeve 72 may include a removable cover plate **72*a* for installation and removal purposes Rigid plastic anti-friction pads 73 may be affixed to inner surfaces of sleeve 72 to promote a relatively smooth energy-efficient movement of carriage 34 on side rails 55 and 56**.

The aforementioned hydraulic motor 38 is mounted on a plate 74 (FIG. 6) that has a pivotal connection 75 with one of the cover plates **72*a*. Motor mounting plate 74 can be swung upwardly around pivotal connection 75 to increase the tension in belt(s) 40. A conventional bolt-type clamp assembly 77 can be used to hold plate 74** in an adjusted position.

Carriage 34 can be powered in the direction of arrow 22 by a hydraulic power unit 78 (FIG. 2). Unit 78 includes two rotary pulleys 79 mounted in individual housings 80 that are affixed to end rails 57 and 58 of sub-frame 32. An elongated hollow fluid cylinder 81 extends between the individual housings 80 to slidably support a fluid piston 83. Flexible cables 82 extend from opposite ends of piston 83 through stuffing boxes at the ends of cylinder 81, and around pulleys 79. The ends of the cables are attached to an anchorage 84 that is suitably affixed to bridge section 70 of carriage 34. Each end housing 80 has a port therein connectable to a hydraulic line for flowing hydraulic fluid to or from the associated end of cylinder 81.

By selectively flowing pressurized fluid into or out of opposite ends of cylinder 81 it is possible to move piston 83 to the right or left along the cylinder Cables 82 act as flexible piston rods to translate piston movement into motion of carriage 34 in the direction of arrow 22. Cylinder 81 is of sufficient length as to permit carriage 34 to move between a position aligned with the wheel 24 centerline and a position aligned with the wheel 26 centerline. The movement distance can be on the order of four feet.

The power unit 78 is shown in the drawing as a fluid cylinder-cable assembly. Other power devices could be utilized. For example, the cable could be powered by a hydraulic motor arranged to rotate one of the pulleys 79 in lieu of cylinder 81.

Carriage 34 is connected to the aforementioned rotary cutting head 36 via two laterally-spaced pillow block bearing units 86. Each bearing unit extends downwardly from one of the aforementioned anti-friction sleeves 72 to provide rotational support for a shaft 87 that extends from the associated end of cutting head 36. One of the shafts has a pulley 88 affixed thereto in driven relation to drive belts 40. The general arrangement is similar to the drive arrangement shown in aforementioned U.S. Pat. No. 4,333,685; see particularly FIG. 3 of that patent.

Cutting head 36 may be equipped with a depth-of-cut control assembly of a type already known in the art, e.g. the structure shown in U.S. Pat. No. 4,333,685. Such a control can include an arm 89 (FIG. 4) having at one end thereof a pivotal connection 90 with carriage 34, and having at its other end an adjustable extensible connection 91, whereby the midpoint 92 of the arm is movable toward or away from the axis of shaft 87. A rocker arm 93 may be pivotably attached to arm 89, as at 94. Road-engageable rollers 95 may be carried at opposite extremities of arm 93.

It can be seen that adjustment of connection 91 will raise or lower pivot point 94 relative to shaft 87, thereby varying the depth of cut of the cutter discs in cutter head 36. The present invention is not concerned directly with the depth-of-cut control mechanism, except that such mechanism should be included in machines embodying preferred forms of the invention.

During a groove-cutting operation, pressurized fluid is admitted to the upper ends of fluid cylinders 59, such that downward forces are applied to the corners of sub-frame 32. The side rails 55 and 56 of the sub-frame transmit such downward forces through carriage 34 onto the shafts 87 of cutting head 36. In this manner the cutting discs are enabled to bite into the concrete surface, rather than merely riding along the surface. When it is not desired to form grooves in the concrete surface, the cutting head is raised by flowing pressurized fluid into the lower ends of cylinders 59.

The machine may be used to form a series of full length grooves in a concrete surface or the like by a combination of movements, including a first movement of main frame 30 by energization of hydraulic motors 54, and an additional second movement of carriage 34 via introduction of pressurized fluid into cylinder 81. Cylinder 81 is double acting and therefore carriage 34 can be moved in a right-to-left direction from road wheels 26 toward road wheels 24, or in a left-to-right direction from road wheels 24 toward road wheels 26.

The machine is designed to form full length transverse grooves in a concrete road surface with a single pass of the machine. The term "full length" is used herein to mean from a point within a few inches of one curb to a point within a few inches of the other curb. A major feature of the invention is the ability of the carriage 34 to be shifted between a location in near adjacency to road wheels 24 and another location in near adjacency to road wheels 26. This shifting capability enables the machine to achieve a full length groove cutting action in a single traverse of the machine across the road surface. It is not necessary to turn the machine around to achieve a full length cut.

The drawings show one form that the invention can take. Other forms are possible within the scope of the appended claims.

I claim:

1. A machine for forming transverse grooves in a road surface, comprising:

a main frame having first and second ends;

first road wheels attached to the main frame near the first end;

second road wheels attached to the main frame near its second end such that the main frame is movable along a path established by the road wheels;

a sub-frame arranged with the main frame for up-and-down motion; said sub-frame having a first sub-frame end in near adjacency to the first end of the main frame, a second sub-frame end in near adjacency to the second end of the main frame, and two parallel rails extending between the first and second sub-frame ends;

a carriage slidably mounted on the sub-frame for motion parallel to the movement path established by the road wheels;

the carriage including anti-friction means movable on the parallel rails between the first and second sub-frame ends, the anti-friction means comprising a hollow sleeve encircling the associated rail; and a grooving cutter head supported by the carriage for forming spaced grooves in a road surface, the carriage having a sufficient motion on the sub-frame so as to permit the cutter head to move between a first position in near adjacency to the first road wheels and a second position in near adjacency to the second road wheels.

2. The machine of claim 1 wherein the anti-friction means further includes anti-friction pads secured to interior surfaces of the associated hollow sleeve in slidable engagement with outer surfaces of the associated rail.

3. A machine for forming transverse grooves in a road surface, comprising:

a main frame having first and second ends;

first road wheels attached to the main frame near the first end;

second road wheels attached to the main frame near its second end such that the main frame is movable along a path established by the road wheels;

a sub-frame arranged with the main frame for up-and-down motion;

a carriage slidably mounted on the sub-frame for motion parallel to the movement path established by the road wheels;

power means for moving the carriage along the sub-frame, the power means comprising a first pulley means attached to a first end of the sub-frame, a second pulley means attached to a second end of the sub-frame, and a cable extending around the pulleys, the cable having an anchorage on the carriage;

a grooving cutter head supported by the carriage for forming spaced grooves in a road surface, the carriage having a sufficient motion on the sub-frame so as to permit the cutter head to move between a first position in near adjacency to the first road wheels and a second position in near adjacency to the second road wheels.

4. The machine of claim 3 wherein the power means further comprises a fluid cylinder mounted on the sub-frame, and a double-acting piston slidably positioned in the fluid cylinder.

5. The machine of claim 4 wherein the cable includes a first cable section extending around the first pulley means and into one end of the fluid cylinder to a fixed connection with one end of the piston, the cable including a second cable section extending around the second pulley means and into the other end of the fluid cylinder to a fixed connection with the other end of the piston.

6. A machine for forming transverse grooves in a road surface, comprising:

a main frame having first and second ends;

first road wheels attached to the main frame near the first end;

second road wheels attached to the main frame near its second end such that the main frame is movable along a path established by the road wheels;

a sub-frame having spaced corners arranged with the main frame for up-and-down motion;

travel-equalization means for ensuring that each corner of the sub-frame undergoes essentially the same equalized vertical travel during up-and-down motion of the sub-frame, said travel equalization means including vertical rack means depending from the main frame at each end thereof, and pinion gear means carried on each end of the sub-frame in meshed engagement with the rack means, each rack-means comprising two laterally-spaced rack structures, each pinion gear means comprising a pinion gear in meshed engagement with each rack structure, a shaft extending between the two pinion gears so that the gears are forced to rotate at the same rate, and bearing means attached to the sub-frame rotatably supporting the shaft;

a carriage slidably mounted on the sub-frame for motion parallel to the movement path established by the road wheels; and a grooving cutter head supported by the carriage for forming spaced grooves in a road surface, the carriage having a sufficient motion on the sub-frame so as to permit the cutter head to move between a first position in near adjacency to the first road wheels and a second position in near adjacency to the second road wheels.

7. A machine for forming transverse grooves in a road surface, comprising:

a main frame comprising two longitudinally extending side beams and two end beams connected to opposite ends of the side beams to form a rectangular main frame;

first non-steerable road wheels attached to the side beams near one of the end beams;

second steerable road wheels attached to the side beams near the other end beam, such that the main frame is movable along a predetermined path that parallels the side beams;

a sub-frame arranged within the main frame for up-and-down motion, the sub-frame comprising two longitudinally extending side rails and two end rails connected to opposite ends of the side rails to form a rectangular sub-frame;

raising and lowering means for raising and lowering the sub-frame without changing the position of the main frame, said raising and lowering means comprising a fluid cylinder located at each corner of the sub-frame so that the corners of the sub-frame have equalized vertical travel during a raising-lowering operation;

a carriage slidably mounted on the sub-frame side rails for motion parallel to the movement path established by the road wheels, the carriage comprising a bridge section extending crosswise of the sub-frame side rails, anti-friction means at each end of the bridge section in guided engagement with the sub-frame side rails, and pillow block bearing means depending from each anti-friction means; and a cutter head located directly below the carriage in a space between the two pillow block bearing means, said cutter head having oppositely extending support shafts extending into respective ones of the pillow block bearing means.

8. The machine of claim 7, further comprising travel-equalization means for ensuring that each corner of the sub-frame undergoes essentially the same equalized vertical travel during up-and-down motion of the sub-frame.

9. The machine of claim 7 and further comprising a power means for moving the carriage along the sub-frame, the power means comprising a first pulley rotatably mounted on one of the sub-frame end rails, a second pulley rotatably mounted on the other sub-frame end rail, and a cable extending around the pulleys, the cable having an anchorage on the bridge section of the carriage.

10. The machine of claim 9 wherein the power means further comprises an additional fluid cylinder mounted on the sub-frame with its cylinder axis parallel to the sub-frame side rails, and a double-acting piston slidably mounted in the additional fluid cylinder for movement along the cylinder axis.

11. The machine of claim 10 wherein the cable has fixed connections with opposite ends of the double-acting piston.

12. A machine for forming transverse grooves in a road surface, comprising:

a main frame having first and second ends;

first road wheels attached to the main frame near the first end;

second road wheels attached to the main frame near its second end such that the main frame is movable along a path established by the road wheels;

a sub-frame having spaced corners arranged with the main frame for up-and-down motion.

a carriage slidably mounted on the sub-frame for motion parallel to the movement path established by the road wheels;

a grooving cutter head supported by the carriage for forming spaced grooves in a road surface, the carriage having a sufficient motion on the sub-frame so as to permit the cutter head to move between a first position in near adjacency to the first road wheels and a second position in near adjacency to the second road wheels;

depth of cut means mounted on said carriage, said depth of cut means operating to independently control and maintain the depth of the grooves formed by said grooving cutter head; and means extending between the main frame and sub-frame for raising or lowering the sub-frame without changing the position of the main frame to alter the downward force applied by the sub-frame to the grooving cutter head.

13. The machine of claim 12, wherein said means extending between said main frame and sub-frame for raising or lowering the sub-frame includes drive means and travel equalization means separate from said drive means for insuring that each corner of the sub-frame undergoes the same equalized vertical travel during the raising or lowering of the sub-frame.

14. The machine of claim 13 wherein the cutter head comprises a plurality of rotary cutter disks axially aligned on an axis that is transverse to the motion path of the carriage on the sub-frame, such that the machine is enabled to form transverse grooves across substantially an entire road surface in a single pass of the machine, said single pass of the machine comprising a movement of the frame via the road wheels, and a slidable motion of the carriage along the sub-frame.

15. The machine of claim 13 wherein the sub-frame has a first end in near adjacency to the first end of the main frame and second end in near adjacency to the second end of the main frame.

16. The machine of claim 15 wherein the sub-frame comprises two parallel rails extending between its first and second ends, the carriage including anti-friction means movable on the rails between the ends of the sub-frame.

17. The machine of claim 13, wherein said travel equalization means includes a rack means carried by either said main frame or sub-frame and pinion gear means cooperating with said rack means, said pinion gear means being carried by either the main frame or sub-frame which does not carry said rack means.

* * * * *